United States Patent [19]

Fujie et al.

[11] 4,126,015

[45] Nov. 21, 1978

[54] AIR COOLING APPARATUS

[75] Inventors: Kunio Fujie, Tokyo; Yoshinori Otsuka, Ushikumachi; Yoshifumi Kunugi, Yokohama; Mituo Kudo, Tsuchiura, all of Japan

[73] Assignee: Hitachi, Ltd., Japan

[21] Appl. No.: 825,045

[22] Filed: Aug. 16, 1977

[30] Foreign Application Priority Data

| | | | |
|---|---|---|---|
| Aug. 20, 1976 | [JP] | Japan | 51-98707 |
| Aug. 20, 1976 | [JP] | Japan | 51-98709 |
| Sep. 27, 1976 | [JP] | Japan | 51-114732 |
| Sep. 27, 1976 | [JP] | Japan | 51-114734 |

[51] Int. Cl.[2] ..... F25D 21/06; F25C 1/14

[52] U.S. Cl. ..... 62/284; 62/303; 62/354

[58] Field of Search ..... 62/284, 303, 345, 347, 62/354; 137/344

[56] References Cited

U.S. PATENT DOCUMENTS

| | | | |
|---|---|---|---|
| 192,233 | 6/1877 | Cook | 62/284 |
| 2,321,262 | 6/1943 | Taylor | 62/284 |
| 2,406,682 | 8/1946 | Hayes et al. | 62/284 |
| 2,441,376 | 5/1948 | Stiening | 62/284 |
| 2,802,341 | 8/1957 | Polk | 62/303 |
| 3,124,940 | 3/1964 | Guelton | 62/284 |
| 3,638,673 | 2/1972 | Stanciu | 137/334 |

*Primary Examiner*—Lloyd L. King

*Attorney, Agent, or Firm*—Craig & Antonelli

[57] ABSTRACT

An air cooling apparatus having a cooler including a plurality of fins arranged in substantially parallel relationship with a predetermined spacing therebetween and heat transfer tubes extending through the fins in a plurality of positions in the fins is further provided with at least one defrosting device having a plurality of projecting members of a width slightly smaller than the spacing between the fins which projecting members are each located between the adjacent two fins. The defrosting device is mounted for rotation about the heat transfer tubes and operative to remove frost from the surfaces of the cooler while rotating which frost has been formed during the operation of the air cooler.

9 Claims, 9 Drawing Figures

AIR COOLING APPARATUS

BACKGROUND OF THE INVENTION

1. FIELD OF THE INVENTION

This invention relates to an air cooling apparatus utilized for cooling air in a space, such as an air cooler in a refrigerating showcase of a freezing and refrigerating system, a cooler for a refrigerating warehouse, an evaporator of an air conditioner, an outdoor heat exchanger of a heat pump of the air cooled type or a brine heat exchanger.

2. DESCRIPTION OF THE PRIOR ART

FIG. 1 is a schematic sectional view in explanation of a typical example of air cooler of the prior art. The air cooler comprises a plurality of fins 2 arranged in substantially parallel relationship with a predetermined spacing therebetween and located between side plates 1, and heat transfer tubes 3 extending through the fins 2 in a plurality of positions in the fins 2.

The air flowing through the fins 2 of the air cooler is cooled, through the fins 2 and heat transfer tubes 3, by a refrigerant flowing through the heat transfer tubes 3.

In this type of air cooler, the moisture in the air condenses and changes into frost which forms on the surfaces of the air cooler. The frost formation tends to markedly reduce the cooling capacity of the air cooler.

If the amount of frost formed on the surfaces of the air cooler increases, the frost will interfere with the flow of the air through the air cooler. Therefore, in order to maintain the cooling capacity of the air cooler at a desired level, it is necessary to effect defrosting of the surfaces of the air cooler from time to time. In one type of processes known in the art for removing frost, the frost is melted by heating. This type of processes include a process in which the air is heated by a heater mounted at the upstream end of the path of the air current with respect to the fins so as to feed the heated air to the air cooler to effect defrosting thereof. Another process relies on spraying of the air cooler with water, warm water or brine. In still another process, a thermal refrigerant is circulated through the portions of the air cooler where the frost formation has taken place. These processes are described, for example, in GUIDE AND DATA BOOK (SYSTEMS), 1970, by ASHRAE, at pages 339–340.

When the frost is heated by heating for the purpose of effecting defrosting, the air cooler must be temporarily shut down while a defrosting operation is being performed. In case the air cooler is utilized for freeze storing of perishable goods, such as foods, a rise in the temperature of the foods will cause deterioration thereof. In case the air cooler is used with an air conditioner, it is impossible to perform air conditioning while defrosting is being performed. Moreover, additional energy will be required for heating the frost, and piping and valves must be provided to carry out warm water spraying or refrigerant circulation. Such being the case, air cooling apparatus of the prior art utilizing conventional defrosting processes have the disadvantage of the increased cost of production of the air cooling apparatus.

SUMMARY OF THE INVENTION

This invention has as its object the provision of an air cooling apparatus which permits defrosting to be effected continuously by mechanical means while the apparatus operates in the cooling mode, without requiring to heat the air cooling apparatus and the ambient air.

According to the invention, the aforementioned object is accomplished by providing the air cooler with at least one defrosting device including a plurality of projecting members each having a width slightly smaller than a spacing between the adjacent two fins arranged in substantially parallel relationship with a predetermined spacing therebetween, each of such projecting members being located between the two adjacent fins and the defrosting device being mounted for rotation about the heat transfer tubes whereby the frost formed on the surfaces of the air cooling apparatus can be scraped off while the defrosting device rotates.

DESCRIPTION OF THE PREFERRED EMBODIMENTS

Figure 1:
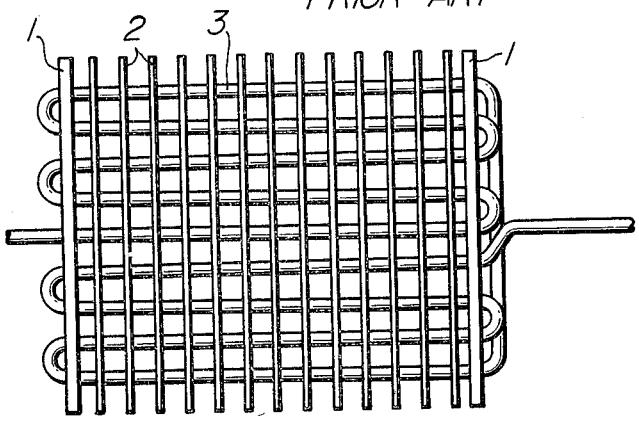
FIG. 1 PRIOR ART
FIG. 1 is a schematic sectional view in explanation of a typical air cooler of the prior art.

The invention will now be described with reference to one embodiment thereof shown in FIGS. 2 to 4. A plurality of fins 4 are arranged in substantially parallel relationship with a predetermined spacing therebetween and mounted between two side plates 5. The fins 4 are each in a so-called doughnut form, with an open space 6 being formed in the central portion thereof to facilitate the flow of the air across the fins 4. Each fin 4 is formed therein with a plurality of cutouts 7 extending radially from the open space 6 in the central portion thereof toward the outer periphery thereof.

Heat transfer tubes 8 extend through the fins 4 in a plurality of positions in the fins 4 located between the cutouts 7 and arranged in rows extending radially from the central open space 6 toward the outer periphery of each fin 4. The outermost heat transfer tubes 8 are disposed inwardly of the forward end of each cutout 7.

In this sepcification, the fins 4 and heat transfer tubes 8 will collectly be referred to as an air cooler.

A defrosting device generally designated by the reference numeral 9 includes a plurality of projecting members 10 each having a width slightly smaller than a spacing between the two adjacent fins 4 and extending inwardly from the forward end of each cutout 7, a connecting member 11 for connecting together all the projecting members 10, a plurality of support members 12 each disposed at either end of the connecting member 11 for supporting the projecting members 10 and the connecting member 11, and a plurality of bearing portions 13 for rotatably supporting the support members 12.

Figure 4:
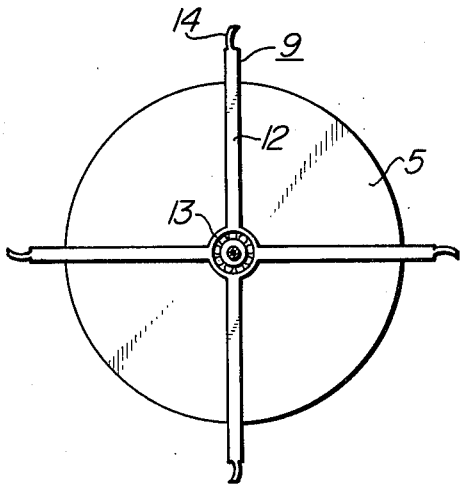
FIG. 4 is a sectional view taken along the line IV—IV of FIG. 2.

Referring to FIG. 4, the defrosting device 9 may be provided in a plurality of numbers at an equal angular spacing from one another on both sides of the fins 4, and supported by receiving portions of the side plates 5 for rotation around the fins 4, with each of the projecting members 10 being inserted in the spacing between the adjacent two fins 4.

The forces for driving the defrosting devices 9 to rotate will now be discussed. An air current can be utilized as a source of such forces. As an air current, the air flowing through the air cooler itself can be utilized. A blower especially intended to drive the defrosting devices 9 may, of course, be provided on the upstream side or downstream side of the air cooler. When an air current is used as a source of forces for driving the defrosting devices 9, air force receiving members 14 may be provided and connected to the defrosting devices 9. The air force receiving members 14 may comprise blades connected to the outer peripheral ends of the connecting members 11 of the defrosting devices 9. The blades are all inclined or curved in the same direction with respect to the direction of rotation of the defrosting devices 9, so that the forces exerted on the blades will vary depending on the positions of the blades. The differences in the forces exerted on the different blades during rotation produces forces which are effective to rotate the defrosting devices 9. If the defrosting devices 9 are rotated, then both sides of each projecting member 10 mechanically scrape the frost off the surfaces of the fins 4 in portions thereof which are near the outer marginal portion of each projecting member 10, while the forward end of the inner periphery of the projecting member 10 scrapes a part of the frost off the surfaces of the outermost heat transfer tubes 8. Thus no frost formation takes place on the surfaces of the outer marginal portions of the fins 4 and the surfaces of the outermost heat transfer tubes 8 in a thickness which exceeds a clearance between the projecting member 10 and these surfaces of the fins 4 and the outermost heat transfer tubes 8. No frost formation occurs on the surfaces of the fins 4 which are disposed inwardly of the projecting member 10, because the frost formed on the heat transfer tubes 8 disposed inwardly of the projections 10 does not spread to the surfaces of the fins 4 by virtue of the presence of the cutouts 7.

It is to be understood that the air force receiving members 14 need not be formed integrally with the defrosting devices 9. Such members 14 may be formed separately and mounted on the defrosting devices 9 in any way as desired so long as forces for rotating the defrosting devices 9 can be transmitted thereto. Thus by using the air force receiving members 14 of a number larger than the number of the defrosting devices 9, it is possible to increase the magnitude of the forces which are exerted on the defrosting devices 9 to thereby smoothly rotate the devices 9.

In the embodiment shown and described hereinabove, the air force receiving members 14 have been described to be provided specially. However, it is to be understood that if the projecting members 10 of the defrosting devices 9 are all inclined or curved in the same direction with respect to the direction of rotation of the defrosting devices 9, it is possible to rotate the defrosting devices 9 by utilizing forces exerted by air.

Figure 2:
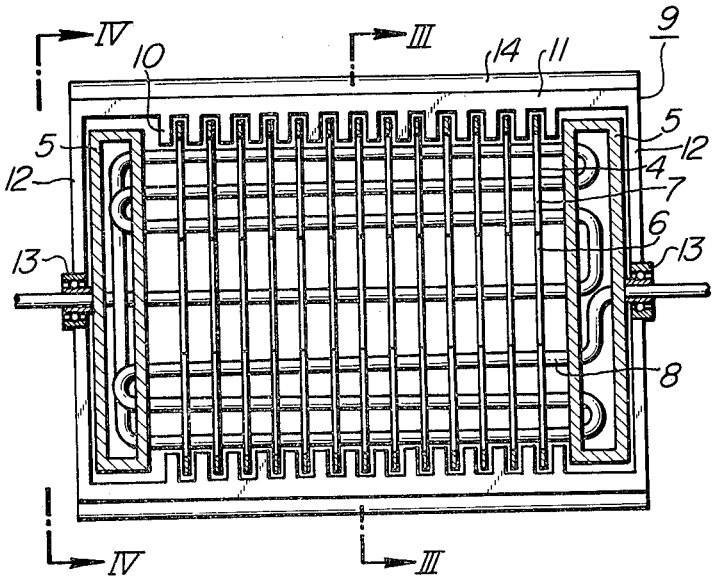
FIG. 2 is a schematic sectional view of the air cooling apparatus comprising one embodiment of the invention.
Figure 3:
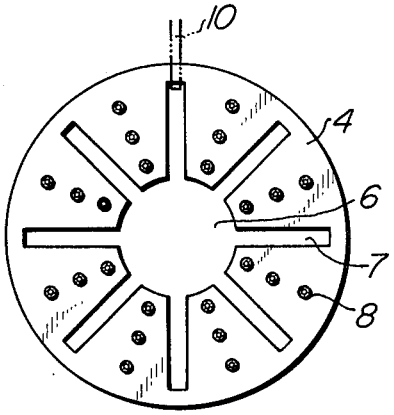
FIG. 3 is a sectional view taken along the line III—III of FIG. 2.
Figure 5:
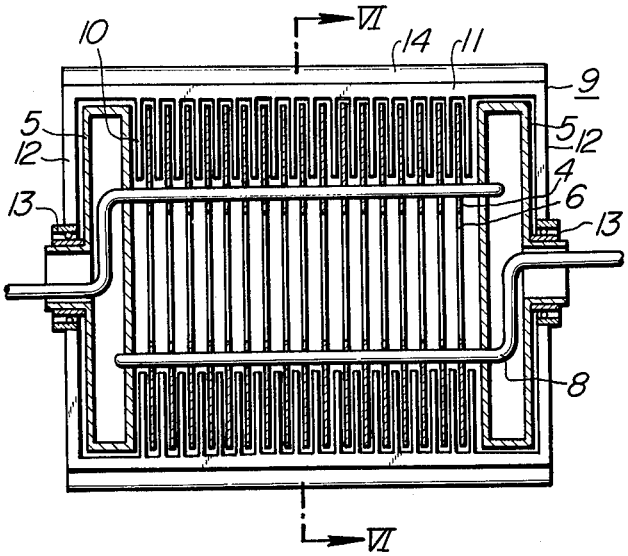
FIG. 5 is a schematic sectional view of the air cooling apparatus comprising another embodiment of the invention.
Figure 6:
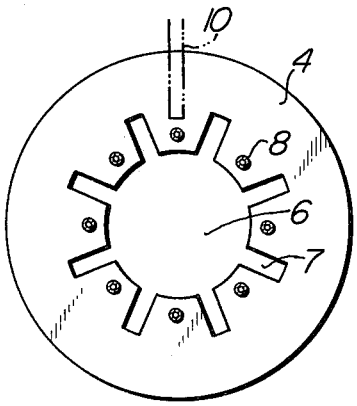
FIG. 6 is a sectional view taken along the line VI—VI of FIG. 5.

FIGS. 5 and 6 show another embodiment of the invention which differs from the embodiment shown in FIGS. 2 to 4 in that the heat transfer tubes 8 are reduced in number and arranged such that each heat transfer tube is disposed on one of imaginary radial lines drawn on the fins 4. In FIGS. 5 and 6, parts similar to those shown in FIGS. 2 to 4 are designated by like reference numerals. The embodiment shown in FIGS. 5 and 6 is constructed such that the open space 6 in each fin 4 is larger in size than the open space 6 in each fin 4 of the embodiment shown in FIGS. 2 to 4 because of the fact that only one heat transfer tube 8 is located between the cutouts 7. Also, the projecting members 10 of the defrosting devices 9 of the embodiment shown in FIGS. 5 and 6 have a larger length than the projecting members 10 shown in FIGS. 2 to 4.

Figure 7:
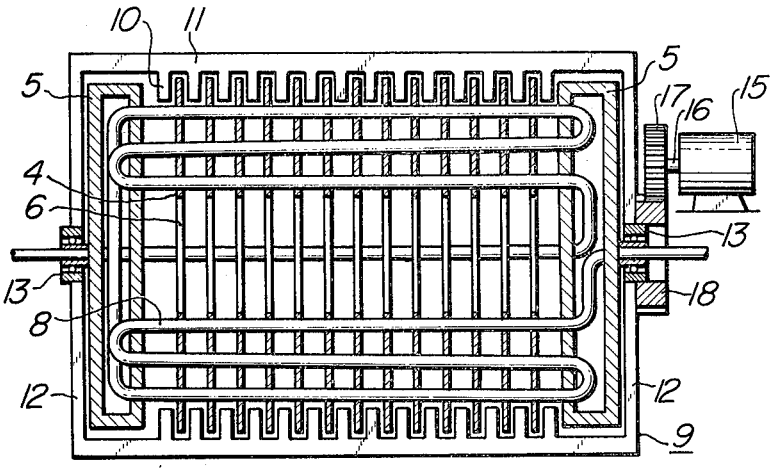
FIGS. 7 and 8 are schematic sectional view of the air cooling apparatus comprising other embodiments of the invention.
Figure 8:
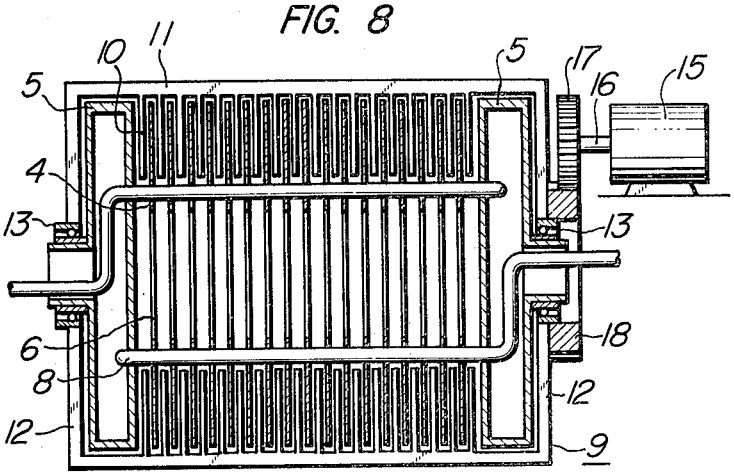

FIGS. 7 and 8 show embodiments which use an electric motor 15 as a source of forces for rotating the defrosting devices 9. In the embodiment shown in FIG. 7, a plurality of numbers of heat transfer tubes are arranged on each of the imaginary radial lines drawn on each fin 4; in the embodiment shown in FIG. 8, only one heat transfer tube 8 is located on each of the imaginary radial lines on each fin 4.

In FIGS. 7 and 8, parts similar to those shown in FIGS. 2 to 6 are designated by like reference numerals. The electric motor 15 is secured to a frame which mounts the air cooler therein, and the rotational speed thereof can be controlled.

The rotation of the electric motor 15 is transmitted to the defrosting devices 9 through a transmission comprising, for example, a gear 17 secured to a rotary shaft 16 and a gear 18 secured to one of the support members 12 of the defrosting devices 9. Thus upon actuation of the electric motor 15, the defrosting devices 9 rotate around the fins 4, so that the projecting members 10 scrape off the frost formed on the surfaces of the fins 4.

If the air cooling apparatus is constructed as shown in FIGS. 7 and 8, defrosting can be effected when necessary, and the number of revolutions can be controlled in accordance with the amount of the frost formed on the surfaces of the fins 4.

Figure 9:
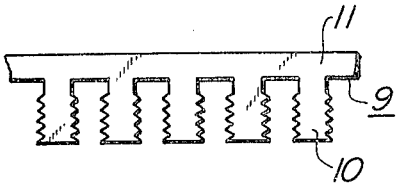
FIG. 9 is a front view, on an enlarged scale, of essential portions of a modified form of projecting members of the defrosting device of the air cooling apparatus according to the invention.

FIG. 9 shows a modified form of projecting members 10 of the embodiments of the defrosting devices 9 of the air cooling apparatus shown in FIGS. 2 to 8. Each projecting member 10 has on both sides thereof ridged surfaces which have elevated and depressed areas thereon.

If the projecting members 10 of each defrosting device 9 is shaped in the form shown in FIG. 9, the surfaces of the frost left on the fins after defrosting is effected by rotating the defrosting devices 9 will be shaped in a manner to have elevated and depressed areas. This increases the surface areas of the frost coming into contact with the air current, thereby increasing heat exchanging efficiency. Also, the presence of the ridged surfaces maintained in contact with the flow of an air current causes stripping of an air boundary layer, thereby further increasing heat exchanging efficiency.

From the foregoing description, it will be appreciated that the air cooling apparatus according to the invention is provided with at least one defrosting device comprising a plurality of projecting members of a width slightly smaller than a spacing between the adjacent two fins and mounted for rotation in the apparatus around the heat transfer tubes with each projecting member interposed between the adjacent two fins. The defrosting device is effective to scrape frost off the surfaces of the air cooler by mechanical means, and can achieve the following advantages:

(1) Defrosting can be effected while the apparatus is operating in a cooling mode, so that when foods are put in freeze storing, no rise in the temperature of the foods occurs and consequently no deterioration thereof is caused.

(2) Since defrosting is performed mechanically, defrosting can be effected positively and in a shorter time than when heat is used for melting the frost.

(3) The defrosting device is constructed such that it is possible to remove frost from the surfaces of outer marginal portions of the fins where the frost tends to form in greatest amounts. This avoids the interference of the frost with the flow of air, so that the air flows to the inner peripheral portions of the fins and cooling can be effected efficiently.

(4) Prolonged operation of the apparatus causes no reduction in the volume of air and hence no reduction in the refrigerating capability. Moreover, the refrigerating apparatus operates with a high degree of efficiency and enables superb results to be achieved in saving energy.

(5) Cost for the production of the apparatus can be reduced as compared with apparatus relying on heating for effecting defrosting, because the need to provide a heating source or a water tank, a piping system and valves for spraying warm water or recirculating a refrigerant can be eliminated.

We claim:

1. An air cooling apparatus comprising:

a cooler comprising a plurality of fins and a plurality of heat transmitting tubes, said fins being arranged in substantially parallel relationship with a predetermined spacing therebetween and each being formed with an open space in the central portion thereof, and said heat transmitting tubes extending through said fins in a plurality of positions in the fins;

at least one defrosting device comprising a plurality of projecting members of a width slightly smaller than the spacing between the adjacent two fins and a connecting member for connecting said projecting members together and mounted on said cooler for rotation; and means for rotating said defrosting device around the heat transfer tubes with each of the projecting members being located between the adjacent two fins.

2. An air cooling apparatus as set forth in claim 1, wherein said fins each having the open space in the central portion thereof are formed therein with cutouts located between the radially arranged heat transfer tubes and extending radially from the peripheral portion of each fin to a position beyond the inner end of each projecting member.

3. An air cooling apparatus as set forth in claim 1, wherein said projecting members of the defrosting device adapted to rotate around the heat transfer tubes have ridged surfaces on both sides thereof.

4. An air cooling apparatus as set forth in claim 1, wherein said fins each having the open space in the central portion thereof are formed therein with cutouts located between the radially arranged tubes and extending radially from the inner peripheral portion of each fin to a position beyond the inner end of each projecting member, and the projecting members of the defrosting device adapted to rotate around the heat transfer tubes have ridged surfaces on both sides thereof.

5. An air cooling apparatus as set forth in claim 1, wherein said means for rotating the defrosting device comprises air force receiving members adapted to receive the pressure of air flowing through the cooler.

6. An air cooling apparatus as set forth in claim 1, wherein said means for rotating the defrosting device comprises a prime mover operatively connected to the rotating device.

7. An air cooling apparatus as set forth in claim 5, wherein said air force receiving members are provided by bending or curving said projecting members of the defrosting device.

8. An air cooling apparatus as set forth in claim 5, wherein said air force receiving members are blades attached to said connecting member of the defrosting device.

9. An air cooling apparatus as set forth in claim 6, wherein said prime mover is an electric motor capable of controlling its rotational speed which is connected to said defrosting device through a transmission means.

* * * * *